US008027600B2

(12) United States Patent
Yoneda et al.

(10) Patent No.: US 8,027,600 B2
(45) Date of Patent: Sep. 27, 2011

(54) APPARATUS FOR IMAGE FORMATION

(75) Inventors: Yoshiharu Yoneda, Osaka (JP); Yoshiaki Hiramoto, Osaka (JP); Naoaki Kurimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 367 days.

(21) Appl. No.: 12/427,861

(22) Filed: Apr. 22, 2009

(65) Prior Publication Data

US 2009/0279908 A1 Nov. 12, 2009

(30) Foreign Application Priority Data

May 7, 2008 (JP) ..... 2008-120907

(51) Int. Cl.
*G03G 15/20* (2006.01)

(52) U.S. Cl. ..... 399/33; 399/69

(58) Field of Classification Search ..... 399/33, 399/67, 69; 347/156
See application file for complete search history.

(56) References Cited

U.S. PATENT DOCUMENTS 5,412,453 A * 5/1995 Matsuo ..... 399/33
6,608,977 B2 * 8/2003 Tamaoki ..... 399/69
7,248,807 B2 * 7/2007 Oka et al. ..... 399/33
2006/0210293 A1 * 9/2006 Sone et al. ..... 399/69
2008/0003007 A1 * 1/2008 Jang ..... 399/69

FOREIGN PATENT DOCUMENTS

| | | |
|---|---|---|
| JP | 02-012412 | 1/1990 |
| JP | 10-143000 | 5/1998 |
| JP | 2000-259033 A | 9/2000 |
| JP | 2002-075591 A | 3/2002 |
| JP | 2007-178968 A | 7/2007 |

* cited by examiner

*Primary Examiner* — Sandra Brase
(74) *Attorney, Agent, or Firm* — Renner, Otto, Boisselle & Sklar, LLP

(57) ABSTRACT

An apparatus for image formation comprises a fixing member, a pressing member, a heating member, a sensor, and a controller. The heating member heats at least one of the fixing and pressing members during a heating operation. The sensor senses the surface temperature of at least one of the fixing and pressing members. If the surface temperature sensed by the sensor exceeds a threshold temperature, the controller stops the heating operation of the heating member. If the sensed temperature drops below the threshold temperature, the controller starts the heating operation of the heating member. The controller includes a period measuring unit for measuring the switching period at which the controller switches the starting and stopping of the heating operation of the heating member. The controller restrains the heating of the fixing and pressing members if the switching period exceeds a reference time.

13 Claims, 9 Drawing Sheets

START
1
SWITCH ON HEATER POWER SUPPLY
S1
S2
HD > HC?
N
Y
SWITCH OFF HEATER POWER SUPPLY
S3
START TO MEASURE TIME
S4
S5
HD < HC?
N
Y
SWITCH ON HEATER POWER SUPPLY
S6
S7
HD > HC?
N
Y
SWITCH OFF HEATER POWER SUPPLY
S8
STOP MEASURING TIME
S9
S10
TD > TC?
N
Y
HC = HC — 5°C
S14
TC = TC + K
S15
S16
HC < H0 — 20°C?
N
Y
DISPLAY NEED FOR MAINTENANCE
S17
END
S11
HC = H0?
N
Y
S13
DISPLAY TEMPERATURE CHANGE
S12
HD < HC?
N
Y
1

APPARATUS FOR IMAGE FORMATION

CROSS REFERENCE

This Nonprovisional application claims priority under 35 U.S.C. §119(a) on Patent Application No. 2008-120907 filed in Japan on May 7, 2008, the entire contents of which are hereby incorporated by reference.

BACKGROUND OF THE INVENTION

The present invention relates to an apparatus for image formation which fixes a developer image on a record medium by heating and pressing the medium.

A copier, a laser printer, or another apparatus for electrophotographic image formation includes a heater, a fixing member, and a pressing member. The heater heats the fixing member. The pressing member is in compressive contact with the fixing member. The fixing and pressing members fix a developer image on a record medium by heating and pressing the medium passing through the nip between these members.

An apparatus for electrophotographic image formation includes a heater, a fixing member, a pressing member, a temperature sensor, and a controller. The temperature sensor senses the surface temperature of the fixing member. The controller adjusts the surface temperature to a specified range by controlling the current supply to the heater according to the sensed temperature.

Part of the paper dust, developer dust, or other dust on the fixing member may stick to the temperature sensor. If dust sticks to the temperature sensor, heat is conducted from the fixing member to the sensor through the dust. The dust on the temperature sensor changes the condition of the sensor as if the heat capacity of the sensor increased. This lowers the responsibility of the temperature sensor to changes in the temperature of the fixing member. As a result, when the temperature sensor senses the threshold temperature at which the current supply to the heater should be cut off, the actual surface temperature of the fixing member may have exceeded the threshold temperature.

The bearings and driving gears of the fixing and pressing members may be resinous. If dust sticks to the temperature sensor, so that the surface temperature of the fixing member rises excessively beyond a specified range, the resinous bearings and gears and other peripheral parts may thermally deform. If the surface temperature rises beyond this range, the fixing and pressing members may not fix a developer image well on a record medium.

JP-H10-143000-A discloses an apparatus for image formation, which includes a main power supply, a fixing member, a temperature sensor, and a controller. The temperature sensor senses the surface temperature of the fixing member. On the basis of the sensed temperature, the controller computes the thermonasty value of the surface temperature rising just after the power supply is switched on and the thermonasty value of the surface temperature dropping just after the supply is switched off. If either of the thermonasty values is outside a reference range, the controller determines that the temperature sensor or the power supply is abnormal.

It is impossible to detect an abnormality of the temperature sensor or the main power supply when the surface temperature of the fixing member neither rises just after the supply is switched on nor drops just after the supply is switched off. For example, if the apparatus is used with the power supply on for a long time, it may be impossible to detect an abnormality of the temperature sensor, except just after the supply is switched on, and except after the supply is switched off. This may make it impossible to detect an abnormality of the temperature sensor for a long time.

The controller of this apparatus needs to compute the thermonasty values, so that the load on the controller is heavy.

The object of the present invention is to provide an apparatus for image formation which prevents the surface temperatures of its fixing and pressing members from excessively rising, except just after the main power supply of the apparatus is switched on, and except after the supply is switched off.

SUMMARY OF THE INVENTION

An apparatus for image formation according to the present invention comprises a fixing member, a pressing member, a heating member, a sensor, and a controller. The fixing and pressing members fix a developer image on a record medium by heating and pressing the medium while the medium is passing through the nip between the fixing and pressing members. The heating member heats at least one of the fixing and pressing members during a heating operation. The sensor senses the surface temperature of at least one of the fixing and pressing members. If the surface temperature sensed by the sensor exceeds a threshold temperature, the controller stops the heating operation of the heating member. If the sensed temperature drops below the threshold temperature, the controller starts the heating operation of the heating member. The controller includes a period measuring unit for measuring the switching period at which the controller switches the starting and stopping of the heating operation of the heating member. The controller restrains the heating of the fixing and pressing members if the switching period exceeds a reference time.

If the heating member starts the heating operation, this member heats at least one of the fixing and pressing members. If the heating operation of the heating member stops, this member heats none of the fixing and pressing members. If the switching period exceeds the reference time, it is considered that the dust on the sensor lowers the responsibility of the sensor. In this case, the controller restrains the heating of the fixing and pressing members. Because the control of the threshold temperature is based on the switching period, this temperature can be controlled except just after the main power supply of the apparatus is switched on, and except just after the supply is switched off.

BRIEF DESCRIPTION OF THE DRAWINGS

In FIG. 4A, the solid curve represents the temperature of the roller surface which is sensed by the temperature sensor when the contact surface of the sensor is clean. In FIG. 4B, the solid curve represents the temperature of the roller surface which is sensed by the sensor when the sensor surface is dusty.

FIG. 8A shows the normal duty ratio. FIG. 8B shows the duty ratio set if the measured time is longer than a preset reference time.

Figure 9A:
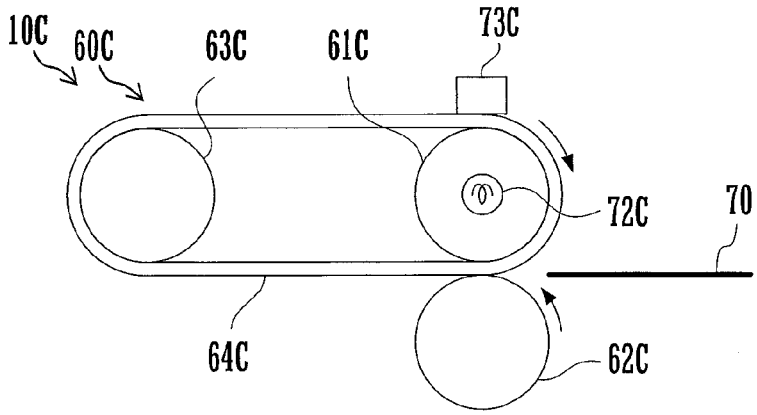
Figure 9B:
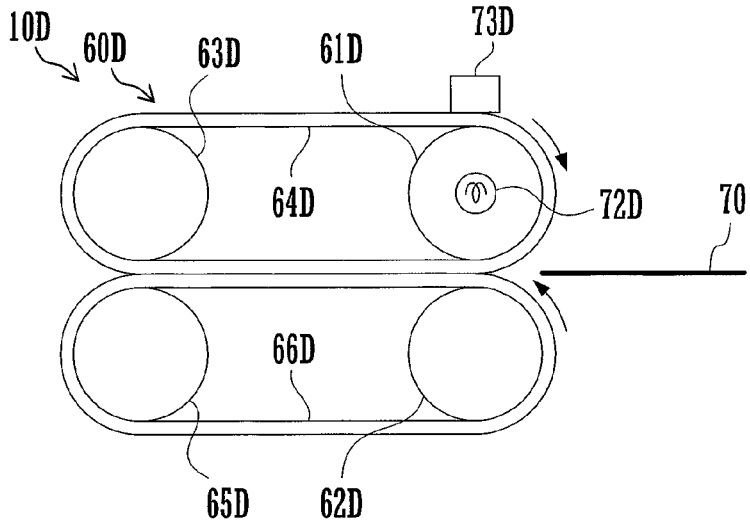
Figure 9C:
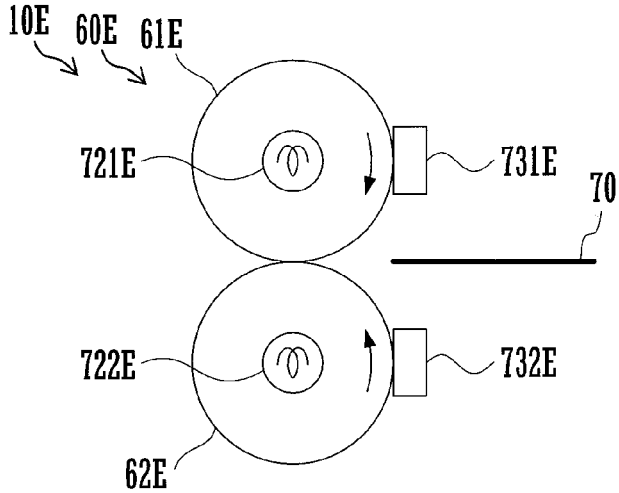

Each of FIGS. 9A-9C is a schematic section of part of an apparatus for image formation according to still another embodiment of the present invention.

DETAILED DESCRIPTION OF THE INVENTION

Figure 1:
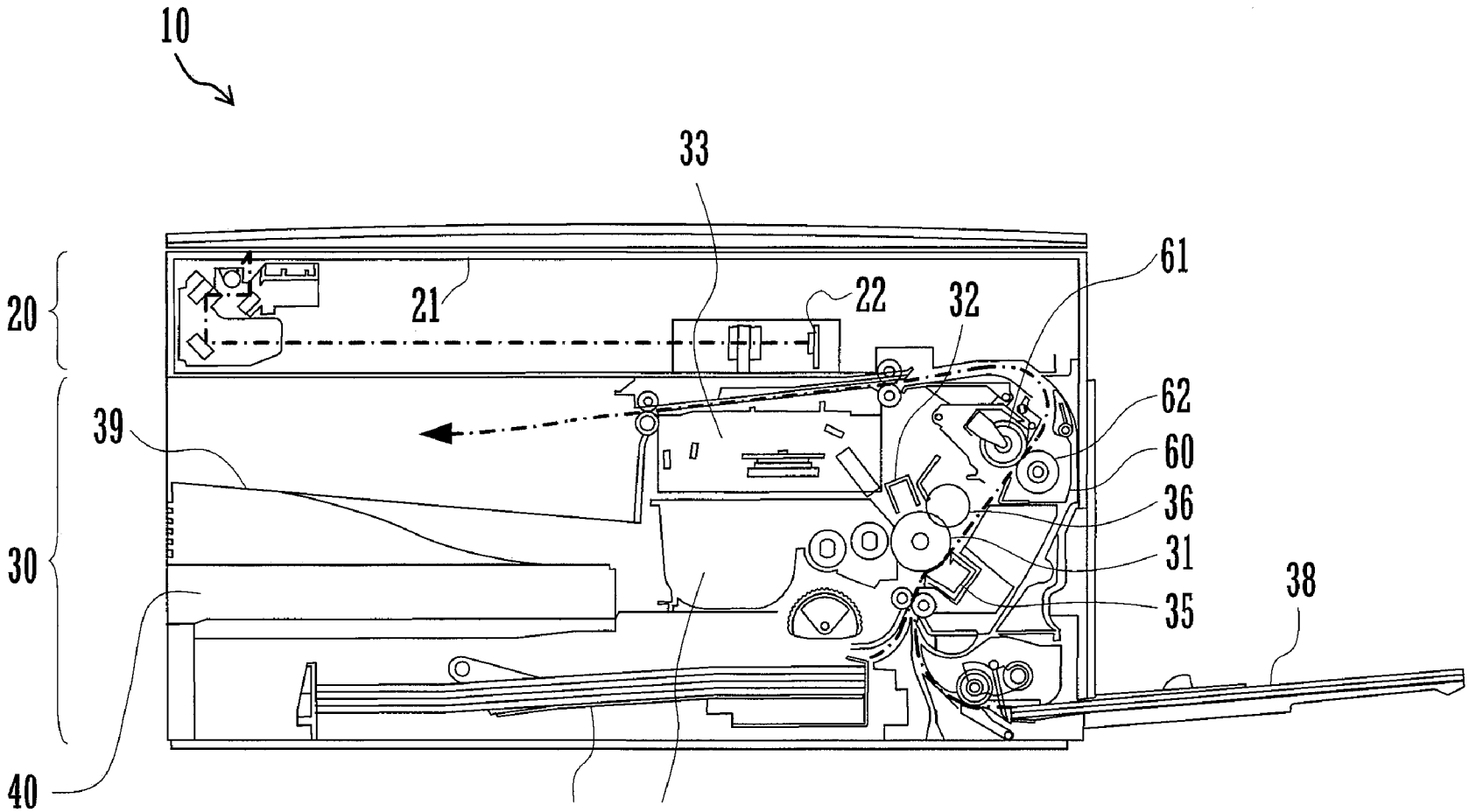
FIG. 1 is a schematic section of an apparatus for image formation according to an embodiment of the present invention.

The best mode of carrying out the present invention will be described below with reference to the accompanying drawings. FIG. 1 is a schematic section of an apparatus for image formation 10 according to an embodiment of the invention. In FIG. 1, the sections of parts of the apparatus 10 are not hatched.

The apparatus 10 includes an image reading section 20, an image forming section 30, and a control section 40. The apparatus 10 forms an image on a sheet of paper or another record medium on the basis of the image data acquired by the image reading section 20 or input from the outside into the image forming section 30.

The image reading section 20 is positioned over the image forming section 30 and includes platen glass 21 and a CCD (charge coupled device) 22. The image reading section 20 acquires image data based on the image on a document on the platen glass 21 by irradiating the document with light and making the CCD 22 photoelectrically convert the light reflected by the document.

The image forming section 30 includes a photosensitive drum 31, a charging unit 32, an exposure unit 33, a developing unit 34, a transfer unit 35, a fixing unit 60, a cleaning unit 36, a feed tray 37, a hand-feed tray 38, and a delivery tray 39.

The photosensitive drum 31 rotates counterclockwise in FIG. 1. The charging unit 32, exposure unit 33, developing unit 34, and transfer unit 35 are positioned in that order around the drum 31 counterclockwise in FIG. 1.

The charging unit 32 charges the cylindrical surface of the photosensitive drum 31 uniformly to a specified potential. The charging unit 32 is a non-contact charging unit but might be a roller type or brush type contact charging unit.

The exposure unit 33 forms an electrostatic latent image on the uniformly charged surface of the photosensitive drum 31 by exposing the surface to light based on image data. The exposure unit 33 is a laser scanning unit, which scans the drum surface in a specified direction with a laser beam. Alternatively, the exposure unit 33 might be a write head with an array of light emitting devices.

The developing unit 34 develops the electrostatic latent image on the photosensitive drum 17 into a visible developer image by applying a developer to the latent image.

The feed tray 37 and hand-feed tray 38 hold sheets of paper for image formation. The sheets on the tray 37 or 38 can be fed one after one to the position between the cylindrical surface of the photosensitive drum 31 and the transfer unit 35.

The transfer unit 35 transfers the developer image on the photosensitive drum 31 to a sheet of paper fed from the tray 37 or 38.

The fixing unit 60 includes a fixing roller 61 and a pressing roller 62, which correspond to the fixing and pressing members respectively of the present invention. While the sheet with the transferred developer image is passing through the nip between the rollers 61 and 62, the fixing unit 60 fixes the developer on the sheet by means of thermo-compression bonding.

The cleaning unit 36 removes and recovers the developer remaining on the cylindrical surface of the photosensitive drum 31 after the developer image is transferred to the sheet.

The sheet with the fixed image is delivered to the delivery tray 39, which holds sheets of paper on which images have been formed.

The control section 40 controls the whole of the apparatus 10.

Figure 2:
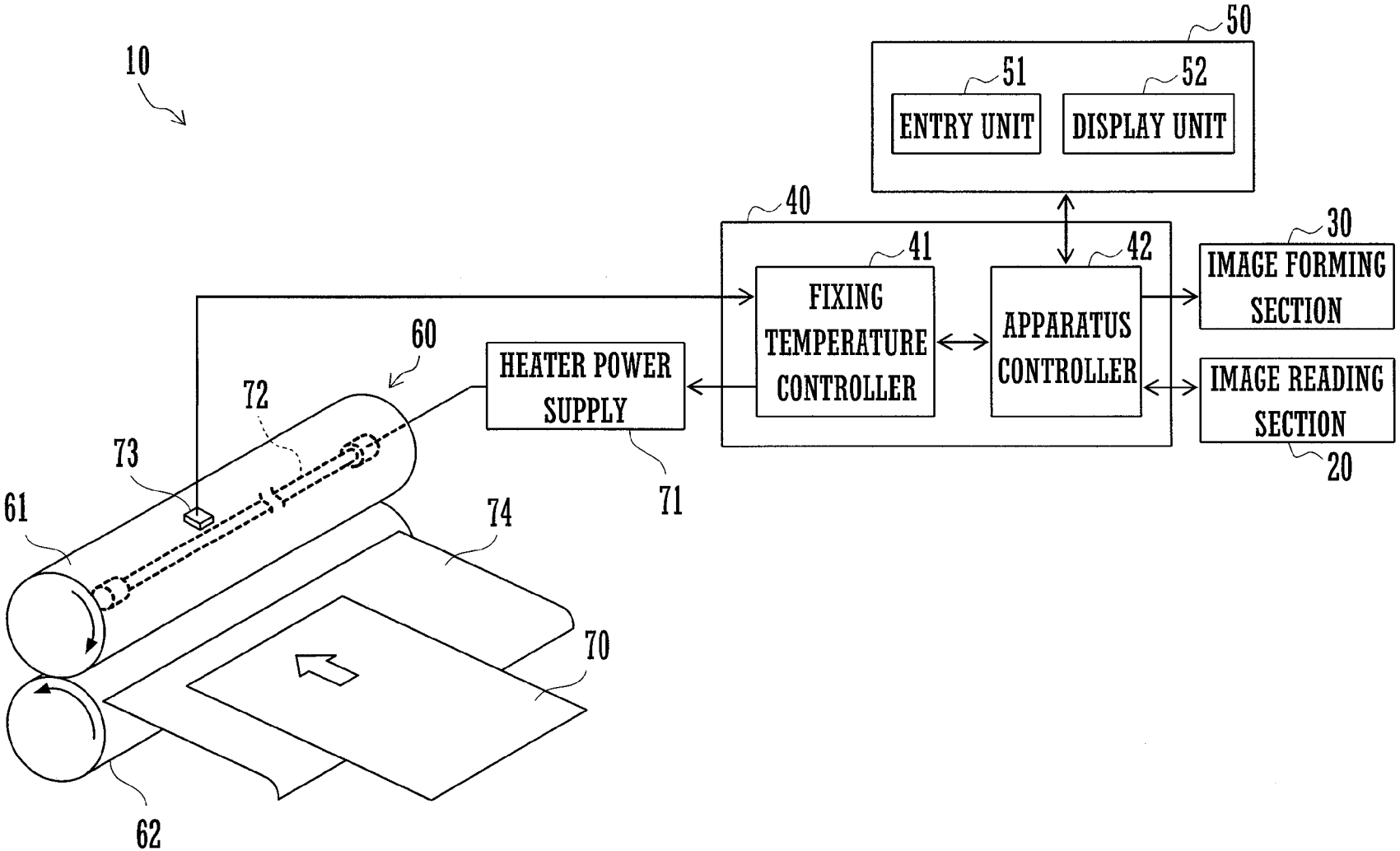
FIG. 2 is a schematic diagram of the apparatus.

FIG. 2 is a schematic diagram of the apparatus 10. In FIG. 2, the fixing unit 60 is shown separately from the image forming section 30 so as to be described in detail. However, the fixing unit 60 forms part of the image forming section 30.

The apparatus 10 further includes an operating section 50, which includes an entry unit 51 and a display unit 52. The entry unit 51 receives control instructions on what conditions are requested to be set for forming an image, how many sheets the image is requested to be formed on, etc. The entry unit 51 includes a touch panel, a ten key, etc. The display unit 52 displays information necessary for the operation of the apparatus 10. The necessary information is based on the display command output from the control section 40. The display unit 52 may be a liquid crystal panel.

The fixing roller 61 is made of metal such as aluminum and can be rotated by the torque supplied from a drive unit (not shown). The fixing roller 61 is fitted with a fixing heater 72 in it, which extends axially of it. The heater 72 heats the cylindrical surface of the fixing roller 61 from the inside of the roller while the heater is supplied with current from a heater power supply 71. The power supply 71 and the heater 72 correspond to the heater of the present invention.

A sheet of paper 70 passes along a paper path extending through the nip between the rollers 61 and 62. A temperature sensor 73 is supported in contact with the cylindrical surface of the fixing roller 61 within the paper path and senses the temperature of the cylindrical surface of the portion of this roller which lies within the path. Alternatively, the sensor 73 might be supported in contact with at least one of the cylindrical surfaces of the rollers 61 and 62 and sense the temperature/s of the roller surface/s. The sensor 73 corresponds to the sensor of the present invention. The sensor 73 is a contact temperature sensor, which may be a thermistor. The sensor 73 outputs the sensed temperature of the cylindrical surface of the fixing roller 61 to the control section 40.

The contact temperature sensor 73 is cheaper and more accurate than non-contact temperature sensors. Accordingly, by using the sensor 73, it is possible to lower the cost of the fixing unit 60 and improve the accuracy of this unit. By sensing the surface temperature within the paper path, it is possible to more accurately control the fixing temperature at which the fixing unit 60 fixes a developer image on a sheet of paper.

The pressing roller 62 is so biased against the fixing roller 61 that the cylindrical surfaces of the rollers are in compressive contact with each other. The pressing roller 62 rotates with the fixing roller 61.

A guide plate 74 guides to the nip between the rollers 61 and 62 a sheet of paper 70 to which an unfixed developer image has been transferred. While the sheet 70 is passing through the roller nip, the rollers 61 and 62 fix the developer on the sheet 70 by means of thermo-compression bonding by heating and pressing the sheet.

The air and sheet 70 in contact with the cylindrical surface of the fixing roller 61 absorb heat from the surface. The temperature of the air is not constant. Sheets of paper vary in thicknesses and water content. In general, the surface temperature of the fixing roller 61 which is suitable for a developer to be fixed on a sheet of paper 70 ranges between 160 and 200 degrees C.

The control section 40 includes a fixing temperature controller 41, which corresponds to the period measuring unit of the present invention, and an apparatus controller 42.

The temperature sensor 73 outputs the sensed temperature to the fixing temperature controller 41. According to the sensed temperature, the fixing temperature controller 41 switches on or off the heater power supply 71 in order to keep the temperature of the cylindrical surface of the fixing roller 61 within a range suitable for a developer to be fixed on a sheet of paper 70. While the heater power supply 71 is activated, it heats the fixing heater 72. While the heater power supply 71 is stopped, it does not heat the heater 72. In other words, while the power supply 71 is activated, it and the heater 72 perform a heating operation. While the power supply 71 is stopped, it and the heater 72 stop the heating operation.

The entry unit 51 outputs control instructions to the apparatus controller 42. In accordance with the control instructions, the apparatus controller 42 controls the operation of the image reading section 20, image forming section 30, and display unit 52.

Figure 3:
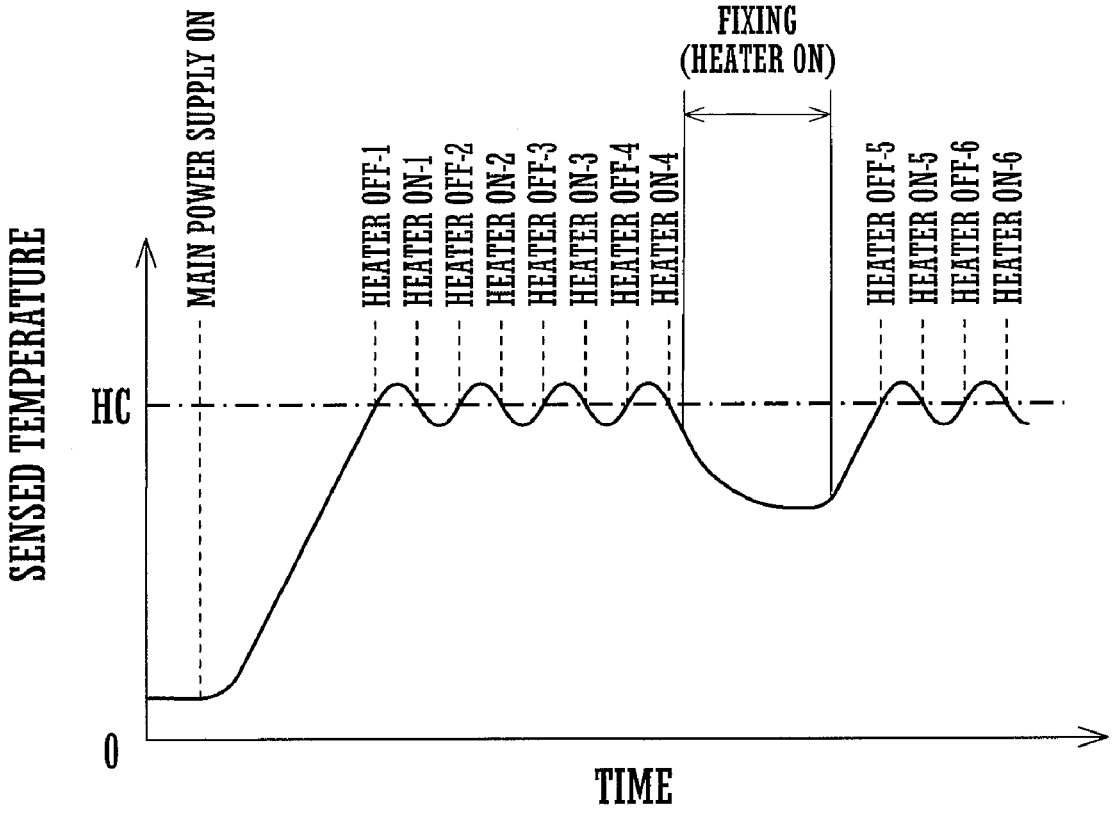
FIG. 3 is a graph of the temperature of the cylindrical surface of the fixing roller of the apparatus, the temperature being sensed by the temperature sensor of the apparatus as the heater power supply of the apparatus is switched on and off.

FIG. 3 shows the surface temperature sensed by the temperature sensor 73 as the heater power supply 71 is switched on and off. In FIG. 3, the time when the heater power supply 71 is switched on is indicated as "HEATER ON", and the time when it is switched off is indicated as "HEATER OFF".

When the main power supply of the apparatus 10 is switched on, the fixing temperature controller 41 switches on the heater power supply 71, starting to heat the fixing heater 72. This starts to raise the sensed temperature of the cylindrical surface of the fixing roller 61. When some time has passed after the main power supply is switched on, the sensed temperature reaches a threshold temperature HC.

If the sensed temperature exceeds the threshold temperature HC while the heater power supply 71 is activated, the fixing temperature controller 41 switches off this supply, stopping heating the fixing heater 72. After the heater power supply 71 stops heating the heater 72, the sensed temperature keeps rising for a while and then starts to drop.

If the sensed temperature drops below the threshold temperature HC while the heater power supply 71 is stopped, the fixing temperature controller 41 switches on this supply, starting to heat the fixing heater 72. After the fixing temperature controller 41 starts to heat the heater 72, the sensed temperature keeps dropping for a while and then starts to rise.

The sensed temperature thus keeps rising or dropping for a while because the fixing roller 61 has a specified heat capacity, which causes the heat generated from the fixing heater 72 to be conducted to the cylindrical surface of the roller 61 gradually at the heat conductivity of this roller.

For example, if the sensed temperature exceeds the threshold temperature HC at Heater Off-1 in FIG. 3 while the heater power supply 71 is activated, the fixing temperature controller 41 switches off this supply. After the heater power supply 71 is switched off, the sensed temperature keeps rising for a while and then drops. If the sensed temperature drops below the threshold temperature HC at Heater On-1 in FIG. 3 while the heater power supply 71 is stopped, the fixing temperature controller 41 switches on this supply. After the heater power supply 71 is switched on, the sensed temperature keeps dropping for a while and then rises.

Likewise, the heater power supply 71 is switched off and on repeatedly after Heater On-1. It is ideal to keep the sensed temperature within a range around the threshold temperature HC when no sheet passes through the nip between the rollers 61 and 62 for a preset time while the heater power supply 71 is activated.

In response to an image formation request from the entry unit 51 or the outside of the apparatus 10 after Heater On-4 in FIG. 3, the fixing unit 60 starts to fix the developer image on the sheet 70 passing through the nip between the rollers 61 and 62. The sheet 70 absorbs heat from the cylindrical surface of the fixing roller 61, so that the sensed temperature drops. While the fixing unit 60 is fixing the image, the fixing temperature controller 41 keeps activating the heater power supply 71 so as to prevent the temperature of the roller surface from dropping excessively.

After the image is fixed, the fixing heater 72 keeps heating the cylindrical surface of the fixing roller 61, without the sheet 70 absorbing heat from the roller surface. As a result, the sensed temperature of the roller surface starts to rise.

If the sensed temperature exceeds the threshold temperature HC at Heater Off-5 in FIG. 3 while the heater power supply 71 is activated, the fixing temperature controller 41 switches off this supply. After the heater power supply 71 is switched off, the sensed temperature keeps rising for a while and then drops. If the sensed temperature drops below the threshold temperature HC at Heater On-5 in FIG. 3 while the power supply 71 is stopped, the fixing temperature controller 41 switches on this supply. After the heater power supply 71 is switched on, the sensed temperature keeps dropping for a while and then rises. Likewise, the heater power supply 71 is switched off and on repeatedly after Heater On-5.

Figure 4A:
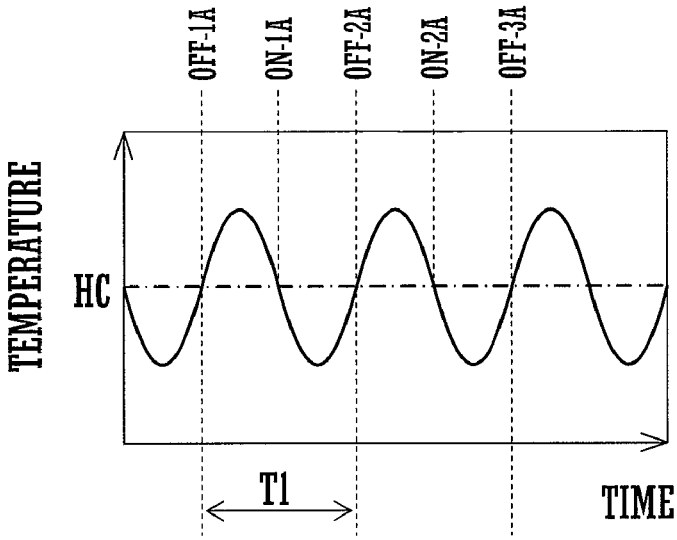
FIGS. 4A and 4B are graphs of the temperatures of the roller surface which change as the heater power supply is switched on and off while the fixing unit of the apparatus is not fixing a developer image on a sheet of paper.
Figure 4B:
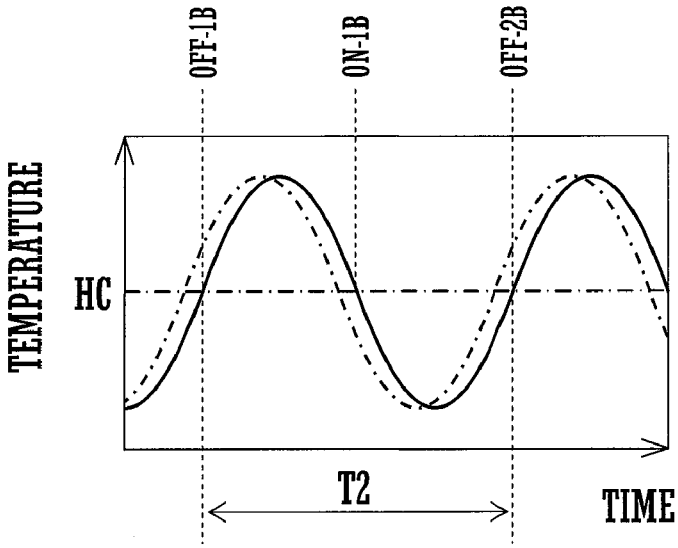

FIGS. 4A and 4B show the temperatures of the cylindrical surface of the fixing roller 61 which change as the heater power supply 71 is switched on and off while the fixing unit 60 is not fixing a developer image on a sheet of paper. In FIGS. 4A and 4B, the chain curves represent the assumed temperature of the roller surface. In FIG. 4A, the solid curve represents the temperature of the roller surface which is sensed by the temperature sensor 73 when the contact surface of the sensor is clean. In FIG. 4B, the solid curve represents the temperature of the roller surface which is sensed by the sensor 73 when the sensor surface is dusty.

In FIGS. 4A and 4B, "ON-1A", "ON-2A", and "ON-1B" indicate points when the heater power supply 71 is switched on. In FIGS. 4A and 4B, "OFF-1A", "OFF-2A", "OFF-3A", "OFF-1B", and "OFF-2B" indicate points when the heater power supply 71 is switched off. With reference to FIGS. 4A and 4B, the fixing temperature controller 41 switches on and off the heater power supply 71 at switching periods T1 and T2 respectively while the fixing unit 60 is not fixing a developer image on a sheet of paper.

As stated already, the temperature sensor 73 is in contact with the cylindrical surface of the fixing roller 61. When the fixing unit 60 fixes a developer image on a sheet of paper 70, the sheet and the developer on it come into contact with the roller surface, so that paper dust, residual developer dust, or other dust may stick to this surface. The rotation of the fixing roller 61 may transfer the sticking dust to the temperature sensor 73 and make the dust stick to the contact surface of the sensor.

If dust sticks to the contact surface of the temperature sensor 73, the heat generated from the fixing heater 72 is conducted through the dust to the sensor surface. The dust on the sensor surface changes the condition of the sensor 73 as if the heat capacity of the sensor increased. This lowers the responsibility of the sensor 73 to the change in the temperature of the cylindrical surface of the fixing roller 61, so that the surface temperature sensed by the sensor 73 is delayed relative to the actual surface temperature.

Accordingly, if the contact surface of the temperature sensor 73 becomes dusty, the switching period T1 becomes the switching period T2, which is longer than it.

If the contact surface of the temperature sensor 73 is clean, the threshold temperature HC is set at an initial threshold temperature H0. If the threshold temperature HC were fixed at the initial threshold temperature H0, the sensed temperature of the cylindrical surface of the fixing roller 61 might not reach the threshold temperature HC even though the actual temperature of the roller surface reaches it when the sensor surface becomes dusty. This would keep the heater power supply 71 activated. If the power supply 71 were not switched off even though the actual roller temperature reaches the threshold temperature HC, the temperature might excessively rise.

If the switching period T2 exceeds a reference time TC, the fixing temperature controller 41 lowers the threshold temperature HC. The controller 41 changes the threshold temperature HC on the basis of the roller surface temperature sensed while the fixing unit 60 is not fixing a developer image on a sheet of paper.

Figure 5:
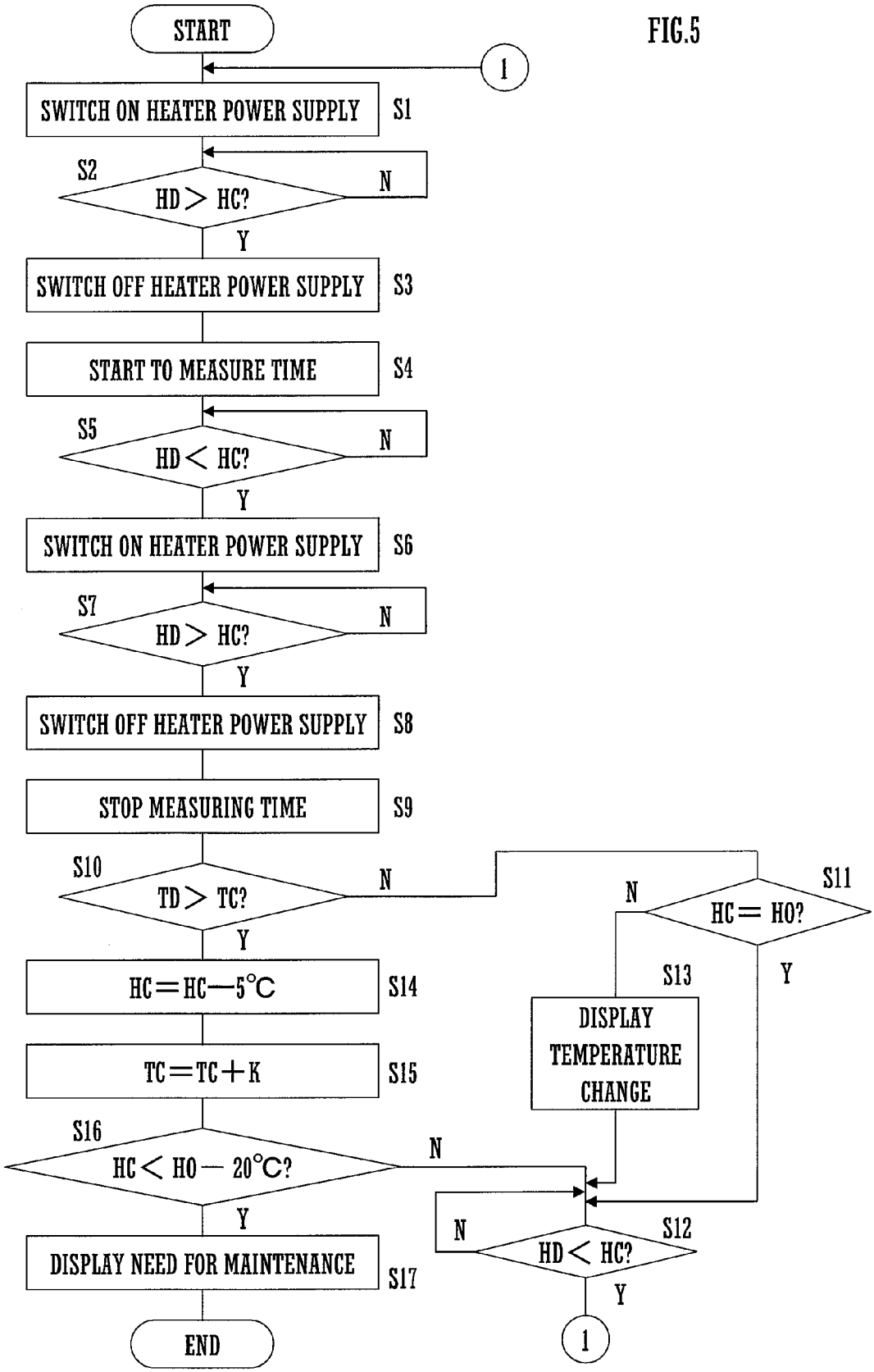
FIG. 5 is a flowchart of the processing performed by the control section of the apparatus.

FIG. 5 is a flowchart of the processing performed by the control section 40.

When the main power supply of the apparatus 10 is switched on, the fixing temperature controller 41 switches on the heater power supply 71 (S1).

The fixing temperature controller 41 waits until the temperature HD sensed by the temperature sensor 73 exceeds the threshold temperature HC. If the sensed temperature HD exceeds the threshold temperature HC (S2), the controller 41 switches off the heater power supply 71 (S3).

When the fixing temperature controller 41 switches off the heater power supply 71, this controller starts to measure time (S4). After the power supply 71 is switched off, the temperature of the cylindrical surface of the fixing roller 61 keeps rising for a while and then starts to drop.

The fixing temperature controller 41 waits until the sensed temperature HD drops below the threshold temperature HC. If the sensed temperature HD drops below the threshold temperature HC (S5), the controller 41 switches on the heater power supply 71 (S6). After the power supply 71 is switched on, the temperature of the cylindrical surface of the fixing roller 61 keeps dropping for a while and then starts to rise.

The fixing temperature controller 41 waits until the sensed temperature HD exceeds the threshold temperature HC again. If the sensed temperature HD exceeds the threshold temperature HC again (S7), the controller 41 switches off the heater power supply 71 (S8).

When the fixing temperature controller 41 switches off the heater power supply 71 (S8), this controller stops measuring time and acquires the measured time TD taken after the controller starts to measure time and until it stops measuring time (S9). The measured time TD corresponds to the switching periods T1 and T2.

The fixing temperature controller 41 compares the measured time TD with the reference time TC (S10).

If the measured time TD is not longer than the reference time TC, the fixing temperature controller 41 compares the threshold temperature HC with the initial threshold temperature H0 (S11).

If the threshold temperature HC is equal to the initial threshold temperature H0, the fixing temperature controller 41 waits until the sensed temperature HD drops below the threshold temperature HC. When the sensed temperature HD drops below the threshold temperature HC (S12), the processing returns to step S1, where the controller 41 switches on the heater power supply 71.

Figure 6:
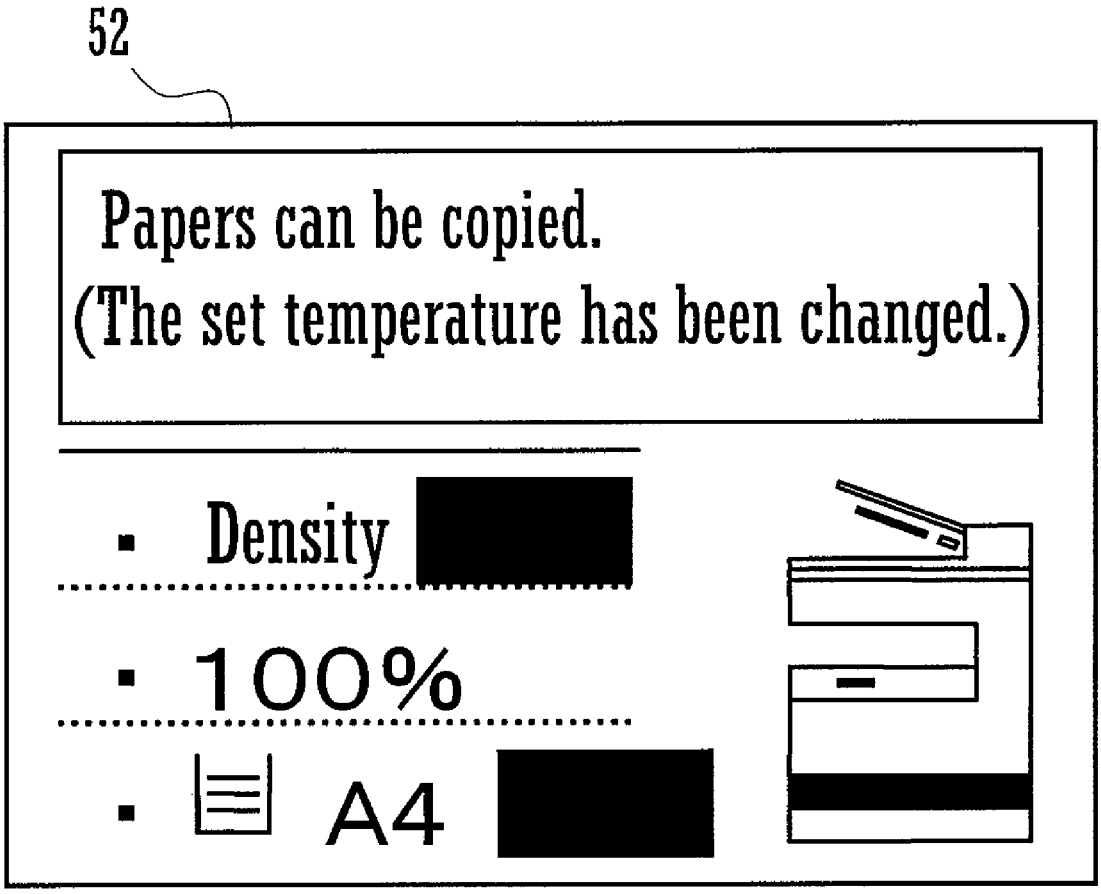
FIG. 6 is a display on the display unit of the apparatus.

If the threshold temperature HC is set at a value different from the initial threshold temperature H0, the fixing temperature controller 41 makes the apparatus controller 42 output to the display unit 52 a display command to display a message that the threshold temperature HC for controlling the fixing temperature has been changed from the initial threshold temperature H0 (S13). Then, the processing goes to step S12. In accordance with the display command, the display unit 52 displays a message that the threshold temperature for fixation has been changed from the initial threshold temperature H0, as exemplified in FIG. 6.

The displayed message that the threshold temperature has been changed from the initial threshold temperature H0 enables the user to know that it is desirable to clean the temperature sensor 73 at routine maintenance time or another time.

Every time the fixing temperature controller 41 determines that the measured time TD is longer than the reference time TC (S10), this controller lowers the threshold temperature HC by a specified temperature, which may be 5 degrees C. (S14).

Thus, if it is considered that the contact surface of the temperature sensor 73 is dusty because the measured time TD is longer than the reference time TC, the fixing temperature controller 41 lowers the threshold temperature HC by the specified temperature so as to switch off the heater power supply 71 earlier. This prevents the temperature of the cylindrical surface of the fixing roller 61 from excessively rising due to a delay in the temperature sensing by the sensor 73.

Every time the fixing temperature controller 41 lowers the threshold temperature HC, this controller lengthens the reference time TC by a specified time K (S15). If the threshold temperature HC is lowered, it is considered that the contact surface of the temperature sensor 73 is dusty. The measured time TD increases with the amount of dust on the sensor surface. Accordingly, by lengthening the reference time TC as the threshold temperature HC is lowered, it is possible to prevent this threshold temperature from being excessively low.

If the threshold temperature HC is not lower than a specified temperature (S16), the processing goes to step S12. This specified temperature is the remainder of the initial threshold temperature H0 from which a specified value is subtracted. The specified value may be 20 degrees C.

Figure 7:
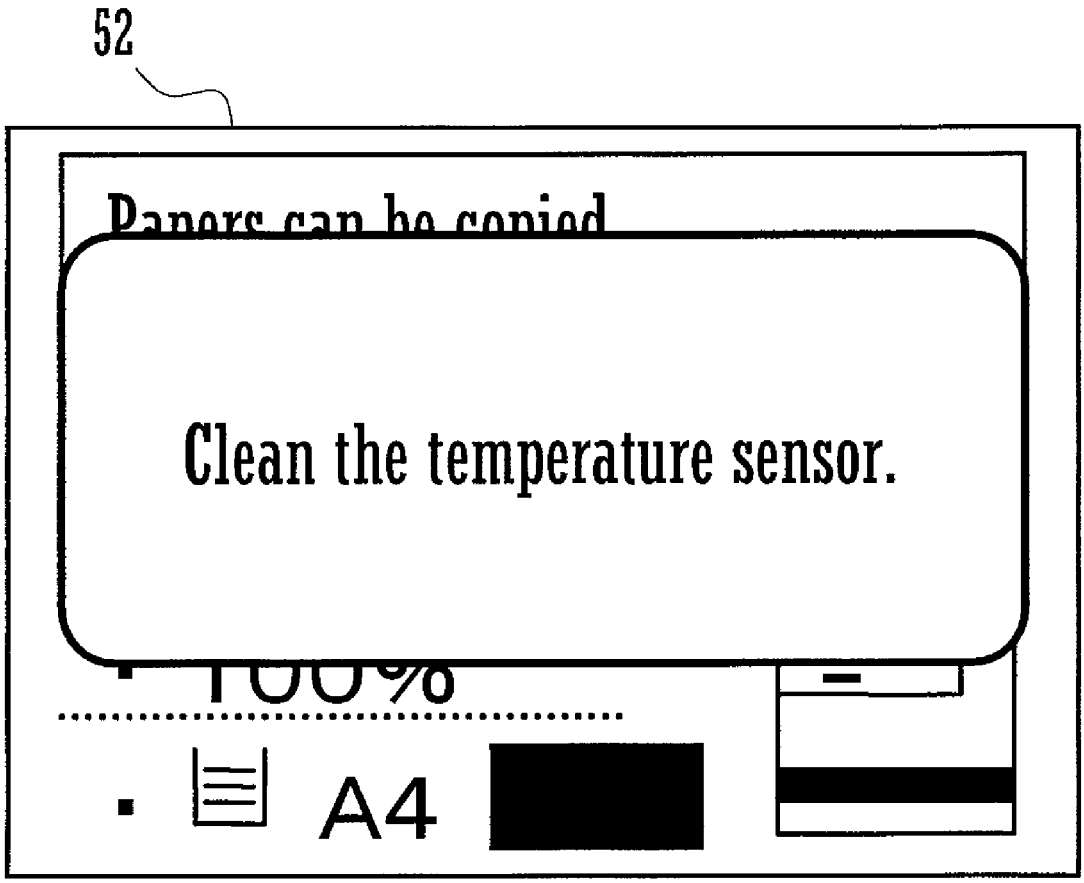
FIG. 7 is another display on the display unit.

If the threshold temperature HC is lower than this specified temperature (S16), the fixing temperature controller 41 makes the apparatus controller 42 output to the display unit 52 a display command to display a message that maintenance including the cleaning of the temperature sensor 73 should be done (S17). In accordance with this display command, the display unit 52 displays a message that the temperature sensor 73 for the fixing unit 60 should be cleaned, as exemplified in FIG. 7.

If the difference between the temperature of the cylindrical surface of the fixing roller 61 and the threshold temperature HC is larger than the specified value, the user is prompted to do maintenance including the cleaning of the temperature sensor 73. This makes it easy to keep within a specified range the fixing temperature at which the fixing unit 60 fixes a developer image on a sheet of paper. This also makes it possible to fix developer images on sheets of paper for a longer time by keeping changing the threshold temperature HC until the display unit 52 displays the message that the maintenance should be done.

If the entry unit 51 receives a message that maintenance including the cleaning of the temperature sensor 73 has been done, the fixing temperature controller 41 resets the threshold temperature HC to the initial threshold temperature H0, which is preset if the sensor is clean, and also resets the reference time TC to a preset initial reference time T0. If the maintenance dusts the contact surface of the temperature sensor 73, the threshold temperature HC is reset to the initial threshold temperature H0. This makes it possible to prevent heat shortage on the cylindrical surface of the fixing roller 61. If the maintenance dusts the sensor surface, the reference time TC is reset to the initial reference time T0. This enables accurate temperature control.

After an operator does maintenance, the operator or the user could reset the threshold temperature HC to the initial threshold temperature H0 on the entry unit 51.

Maintenance might be done every time the apparatus 10 has formed an image or images on a specified number of sheets of paper. After an operator does this maintenance, the operator or the user could reset the threshold temperature HC to the initial threshold temperature H0 by clearing a counter for detection of maintenance timing on the entry unit 51.

The fixing temperature controller 41 controls the threshold temperature HC on the basis of the period at which this controller switches on and off the heater power supply 71 while the fixing unit 60 is not fixing a developer image on a sheet of paper. This makes it possible to control the temperature of the cylindrical surface of the fixing roller 61 regardless of types of paper and developer.

It is possible to adjust the temperature of the cylindrical surface of the fixing roller 61 to a specified range without fitting the apparatus 10 with a cleaner for cleaning the temperature sensor 73. Because the apparatus 10 does not need to be fitted with a cleaner, the apparatus can be less costly and smaller in size.

Even if an apparatus for image formation is fitted with a cleaner, the cleaner may not be able to completely dust the temperature sensor of this apparatus, so that the surface temperature of the fixing roller of this apparatus may not be adjusted to a specified range.

The fixing temperature controller 41 might switch off the heater power supply 71 if the temperature sensed by the temperature sensor 73 exceeded a first threshold temperature. The controller 41 might switch on the power supply 71 if the sensed temperature dropped below a second threshold temperature lower than the first threshold temperature.

At step S14, the fixing temperature controller 41 would lower the first threshold temperature or the first and second threshold temperatures by a specified value. If the contact surface of the temperature sensor 73 is clear, the first threshold temperature is set at a first initial threshold temperature. At step S16, the fixing temperature controller 41 would compare the first threshold temperature with a specified temperature, which is lower than the first initial threshold temperature by a specified value. If the first threshold temperature is not lower than the specified temperature, the processing would go to step S12. If the first threshold temperature is lower than the specified temperature, the processing would go to step S17.

Figure 8A:
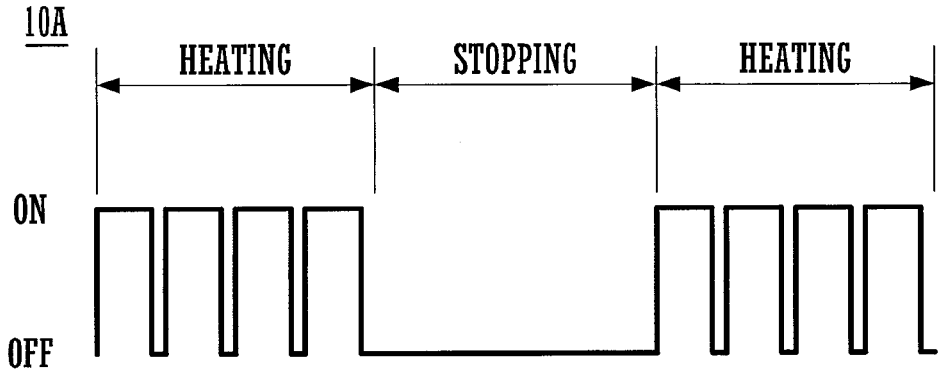
FIGS. 8A and 8B are graphs showing the duty ratios of an apparatus for image formation according to another embodiment of the present invention.
Figure 8B:
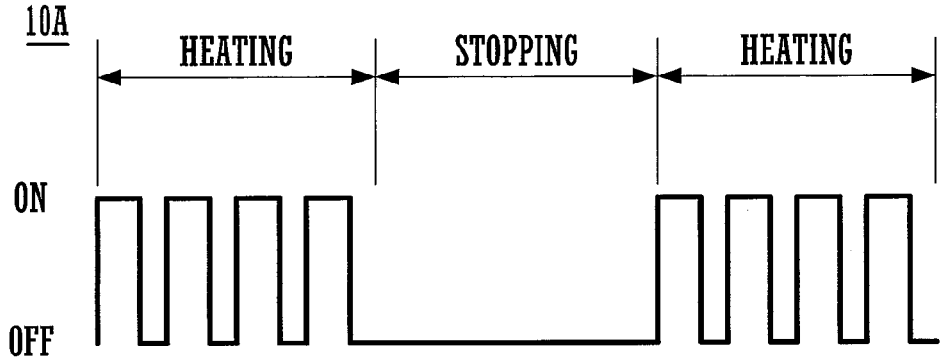

FIGS. 8A and 8B show the duty ratios of an apparatus for image formation 10A according to another embodiment of the present invention. FIG. 8A shows the normal duty ratio. FIG. 8B shows the duty ratio set if the measured time TD is longer than a preset reference time TC2.

If the sensed temperature HD exceeds the threshold temperature HC while the fixing heater 72 of the apparatus 10A is heated, the fixing temperature controller 41 of this apparatus stops heating the heater. If the sensed temperature HD drops below the threshold temperature HC while the heater 72 is heated, the controller 41 starts to heat the heater.

While the fixing heater 72 of the apparatus 10A is heated, the heater power supply 71 of this apparatus is switched on and off repeatedly. While this heater 72 is not heated, this supply 71 is kept inactive.

Each of the duty ratios is the ratio of the time for which the heater power supply 71 of the apparatus 10A is activated to supply current to the fixing heater 72 of this apparatus to the heating time for which the heater is heated.

Normally, the measured time TD is not longer than the reference time TC2. Normally, as shown in FIG. 8A, the fixing temperature controller 41 of the apparatus 10A activates the heater power supply 71 of this apparatus to supply current to the fixing heater 72 of this apparatus for the time which is the product of the heating time and the normal duty ratio (for example, 80%).

If the measured time TD is longer than the reference time TC2, it is considered that the contact surface of the temperature sensor 73 of the apparatus 10A is dusty. In this case, as shown in FIG. 8B, the fixing temperature controller 41 of the apparatus 10A lowers the duty ratio by a specified value, which may be 10%.

The lowered duty ratio lowers the rate at which the fixing heater 72 of the apparatus 10A heats the cylindrical surface of the fixing roller 61 of this apparatus. This lowers the rate at which the temperature of the roller surface rises. As a result, the surface temperature is prevented from rising excessively.

Figure 8C:
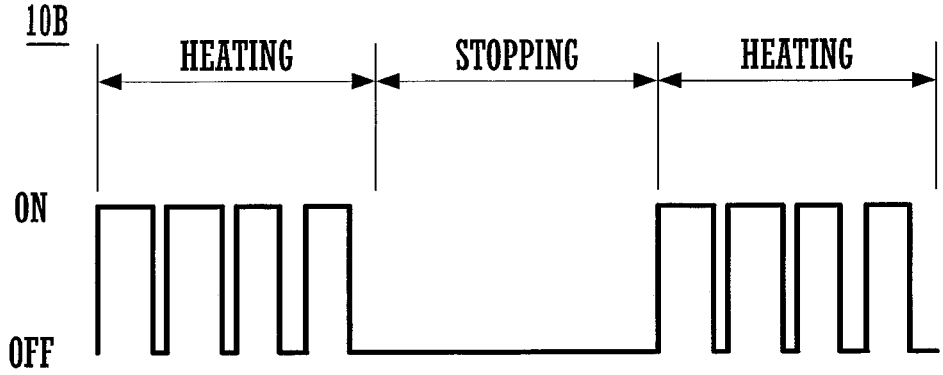
FIG. 8C is a graph showing the duty ratio set if the measured time is longer than a preset reference time in an apparatus for image formation according to still another embodiment of the present invention.

FIG. 8C shows the duty ratio set if the measured time TD is longer than a preset reference time TC in an apparatus for image formation 10B according to still another embodiment of the present invention.

After a specified time passes after the fixing heater 72 of the apparatus 10B starts to be heated, the fixing temperature controller 41 of this apparatus shortens the time for which the heater power supply 71 of this apparatus supplies current to the heater 72 per unit time.

For example, during a specified early period after the time when the fixing heater 72 starts to be heated, the fixing temperature controller 41 may activate the heater power supply 71 to supply current to the heater 72 at an initial duty ratio of 80%. After the early period, the controller 41 may activate the power supply 71 to supply current to the heater 72 at a duty ratio of 70%, which is lower than the initial duty ratio by 10%.

During the early period, the cylindrical surface of the fixing roller 61 of the apparatus 10B is heated as is done normally. This makes it possible to quickly raise the temperature of the roller surface. After the early period, the fixing temperature controller 41 of this apparatus lowers the rate at which the fixing heater 72 of this apparatus heats the roller surface. This makes it possible to prevent the surface temperature from rising excessively.

In each of the embodiments, the fixing heater 72 might be adapted to heat at least one of the fixing roller 61 and pressing roller 62. In each of the embodiments, the temperature sensor 73 might be adapted to sense the temperature of at least one of the cylindrical surfaces of the rollers 61 and 62.

At least one of the fixing and pressing members of the present invention is not limited to a roller but may be a belt. For example, even if part of the apparatus 10, 10A, or 10B is modified as shown in FIG. 9A, 9B, or 9C, the surface temperatures of the fixing and pressing rollers are prevented from rising excessively.

FIG. 9A is a schematic section of part of an apparatus for image formation 10C according to still another embodiment of the present invention. In FIG. 9A, the sections of parts of the apparatus 10C are not hatched.

The fixing unit 60C of the apparatus 10C includes a first fixing roller 61C, a second fixing roller 63C, an endless fixing belt 64C, a temperature sensor 73C, and a pressing roller 62C. The fixing belt 64C and pressing roller 62C correspond to the fixing and pressing members respectively of the present invention.

The fixing belt 64C runs between the fixing rollers 61C and 63C. The pressing roller 62C is so biased toward the first fixing roller 61C that the cylindrical surface of the pressing roller is in compressive contact with the fixing belt 64C. The first fixing roller 61C is fitted with a fixing heater 72C in it. The sensor 73C senses the temperature of the outer surface of the portion of the belt 64C which is in contact with the first fixing roller 61C. A sheet of paper 70 passes through the nip between the belt 64C and pressing roller 62C.

The sensed temperature of the outer surface of the fixing belt 64C is the basis for controlling the threshold temperature set for the fixing heater 72C. This prevents the temperatures of the first fixing roller 61C and fixing belt 64C from rising excessively.

FIG. 9B is a schematic section of part of an apparatus for image formation 10D according to still another embodiment of the present invention. In FIG. 9B, the sections of parts of the apparatus 10D are not hatched.

The fixing unit 60D of the apparatus 10D includes a first fixing roller 61D, a second fixing roller 63D, an endless fixing belt 64D, a temperature sensor 73D, a first pressing roller 62D, a second pressing roller 65D, and an endless pressing belt 66D. The belts 64D and 66D correspond to the fixing and pressing members respectively of the present invention.

The fixing belt 64D runs between the fixing rollers 61D and 63D. The pressing belt 66D runs between the pressing rollers 62D and 65D. The first pressing roller 62D is so biased toward the first fixing roller 61D that the belts 64D and 66D are in compressive contact with each other between these rollers. The second pressing roller 65D is so biased toward the second fixing roller 63D that the belts 64D and 66D are in compressive contact with each other between these rollers. The first fixing roller 61D is fitted with a fixing heater 72D in it. The sensor 73D senses the temperature of the outer surface of the portion of the fixing belt 64D which is in contact with the first fixing roller 61D. A sheet of paper 70 passes through the nip between the belts 64D and 66D.

The sensed temperature of the outer surface of the fixing belt 64D is the basis for controlling the threshold temperature set for the fixing heater 72D. This prevents the temperatures of the first fixing roller 61D and fixing belt 64D from rising excessively.

FIG. 9C is a schematic section of part of an apparatus for image formation 10E according to still another embodiment of the present invention. In FIG. 9C, the sections of parts of the apparatus 10E are not hatched.

The fixing unit 60E of the apparatus 10E includes a fixing roller 61E, a pressing roller 62E, and two temperature sensors 731E and 732E. The rollers 61E and 62E correspond to the fixing and pressing members respectively of the present invention.

The pressing roller 62E is so biased against the fixing roller 61E that the cylindrical surfaces of the rollers are in compressive contact with each other. The rollers 61E and 62E are fitted with a fixing heater 721E and a fixing heater 722E respectively in them. The sensors 731E and 732E sense the temperatures of the cylindrical surfaces of the rollers 61E and 62E respectively. A sheet of paper 70 passes through the nip between the rollers 61E and 62E.

The temperature sensed by at least one of the sensors 731E and 732E is the basis for controlling the threshold temperature set for the associated fixing heater 721E or 722E. This prevents the surface temperature of at least one of the rollers 61E and 62E from rising excessively.

The present invention being thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for image formation comprising:

a fixing member;

a pressing member;

the fixing and pressing members forming a nip therebetween and adapted to fix a developer image on a record medium by heating and pressing the medium while the medium is passing through the nip;

a heating member for heating at least one of the fixing and pressing members during a heating operation;

a sensor for sensing the surface temperature of at least one of the fixing and pressing members; and a controller for stopping the heating operation of the heating member if the surface temperature sensed by the sensor exceeds a threshold temperature, and for starting the heating operation of the heating member if the sensed temperature drops below the threshold temperature;

the controller including a period measuring unit for measuring the switching period at which the controller switches the starting and stopping of the heating operation of the heating member;

wherein the controller restrains the heating of the fixing and pressing members if the switching period exceeds a reference time.

2. An apparatus for image formation as claimed in claim 1, wherein the controller restrains the heating of the fixing and pressing members by lowering the threshold temperature.

3. An apparatus for image formation as claimed in claim 2, wherein the controller lowers the threshold temperature on the basis of the surface temperature sensed by the sensor when no record medium passes through the nip between the fixing and pressing members for a specified time during the heating operation of the heating member.

4. An apparatus for image formation as claimed in claim 2, further comprising a display for displaying information based on display commands output from the controller;

wherein, if the controller has lowered the threshold temperature, the controller outputs a display command to display information that the threshold temperature has been lowered.

5. An apparatus for image formation as claimed in claim 4, wherein, if the threshold temperature is set lower than a specified temperature, the controller outputs a display command to display information that maintenance should be done on the sensor.

6. An apparatus for image formation as claimed in claim 2, wherein, if the controller receives information that maintenance has been done on the sensor, the controller resets the threshold temperature to an initial value.

7. An apparatus for image formation as claimed in claim 2, wherein the controller sets the reference time longer as the threshold temperature drops.

8. An apparatus for image formation as claimed in claim 1, wherein the controller restrains the heating of the fixing and pressing members by lowering the duty ratio being the ratio of the time for which the heating member is supplied with current to the time for which the heating operation of the heating member is performed.

9. An apparatus for image formation as claimed in claim 8, wherein the controller restrains the heating of the fixing and pressing members by shortening the time for which the heating member is supplied with current per unit time after a specified time passes after the heating operation of the heating member is started.

10. An apparatus for image formation as claimed in claim 1, wherein the record medium passes along a paper path extending through the nip between the fixing and pressing members, and wherein the sensor senses the surface temperature of the portion of at least one of the fixing and pressing members which lies within the path.

11. An apparatus for image formation as claimed in claim 1, wherein the sensor is a contact temperature sensor in contact with the surface of at least one of the fixing and pressing members.

12. An apparatus for image formation as claimed in claim 1, wherein at least one of the fixing and pressing members is a roller.

13. An apparatus for image formation as claimed in claim 1, wherein at least one of the fixing and pressing members is a belt.

* * * * *